US007682427B2

(12) United States Patent
Bologa et al.

(10) Patent No.: US 7,682,427 B2
(45) Date of Patent: Mar. 23, 2010

(54) TUBULAR COLLECTOR FOR PRECIPITATING ELECTRICALLY LOADED AEROSOLS FROM A GAS STREAM

(75) Inventors: Andrei Bologa, Stutensee (DE); Hanns-Rudolf Paur, Karlsruhe (DE); Klaus Woletz, Eggenstein-Leopoldshafen (DE); Thomas Wäscher, Heidelberg (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 368 days.

(21) Appl. No.: 11/578,583

(22) PCT Filed: Mar. 31, 2005

(86) PCT No.: PCT/EP2005/003357

§ 371 (c)(1), (2), (4) Date: Jul. 31, 2007

(87) PCT Pub. No.: WO2005/099904

PCT Pub. Date: Oct. 27, 2005

(65) Prior Publication Data

US 2007/0283903 A1 Dec. 13, 2007

(30) Foreign Application Priority Data

May 14, 2004 (DE) ..... 10 2004 023 967

(51) Int. Cl.
*B03C 3/49* (2006.01)
*B03C 3/78* (2006.01)

(52) U.S. Cl. ..... 96/44; 55/DIG. 38; 95/75; 96/49; 96/53

(58) Field of Classification Search ..... 96/44, 96/49, 53; 55/360, DIG. 38; 95/64–66, 71, 95/75

See application file for complete search history.

(56) References Cited

U.S. PATENT DOCUMENTS 3,765,154 A * 10/1973 Hardt et al. ..... 96/88

(Continued)

FOREIGN PATENT DOCUMENTS

DE 101 32 582 C1 8/2002

(Continued)

OTHER PUBLICATIONS

International Search Report issued in PCT/EP20005/003357, dated Oct. 6, 2005.

(Continued)

*Primary Examiner*—Richard L Chiesa
(74) *Attorney, Agent, or Firm*—Venable LLP; Robert Kinberg; Leigh D. Thelen

(57) ABSTRACT

A tubular collector for precipitating electrically loaded aerosols from a gas stream stands vertically in a gas stream duct. The stream flows upwards in the section. The tubular collector includes at least one group of pipe bundle which extends at the most over the internal width of the duct and including at least one dimensionally stable pipe bundle whose lower side or side that faces the flow rests on a grating or perforated metal sheet connected to an electric reference potential. At least the top side or side away from the stream of a group of pipe bundles is uniformly sprayed with rinsing liquid. The pipes of a group of pipe bundles are held apart by spacers so that the stream flows over their outer and inner sides. The pipes of a group of pipe bundles are identical and have different adjustment heights. The pipes have such a length that at least when a turbulent flow enters one pipe, a laminar gas stream is formed downstream.

18 Claims, 4 Drawing Sheets

U.S. PATENT DOCUMENTS

| | | | | |
|---|---|---|---|---|
| 3,793,802 | A * | 2/1974 | Hardt | 96/99 |
| 4,072,477 | A * | 2/1978 | Hanson et al. | 95/71 |
| 4,155,792 | A * | 5/1979 | Gelhaar et al. | 156/172 |
| 4,247,307 | A | 1/1981 | Chang et al. | |
| 5,254,155 | A | 10/1993 | Mensi et al. | |
| 5,401,301 | A * | 3/1995 | Schulmerich et al. | 96/71 |
| 6,579,349 | B1 * | 6/2003 | Ting et al. | 96/44 |
| 6,599,349 | B1 | 7/2003 | Scharkowski | |
| 6,858,064 | B2 * | 2/2005 | Bologa et al. | 95/65 |
| 7,517,394 | B2 * | 4/2009 | Bologa et al. | 96/52 |

FOREIGN PATENT DOCUMENTS

| | | |
|---|---|---|
| DE | 102 44 051 C1 | 11/2003 |

OTHER PUBLICATIONS

Written Action from the International Search Office PCT/EP2005/003357 (Oct. 6, 2005).

* cited by examiner

TUBULAR COLLECTOR FOR PRECIPITATING ELECTRICALLY LOADED AEROSOLS FROM A GAS STREAM

CROSS-REFERENCE TO RELATED APPLICATION

This application is the U.S. National Stage of International Application No. PCT/EP05/003357, filed on Mar. 31, 2005, which claims the priority benefit of German Application No. 10 2004 023 967.3, filed on May 14, 2004. The entire content of the foregoing applications is incorporated herein by reference.

BACKGROUND OF THE INVENTION

The invention relates to a tubular collector in the form of a built-in duct section for precipitating electrically charged aerosols from a gas stream flowing through the duct.

The cleaning of submicron particles from a gas is a presently relevant problem. German reference DE 101 32 582, for example, describes the precipitation of charged aerosols. The collector for said arrangement consists of a casing, a grid connected to ground, and a thereon positioned bundle of tubes, with the individual tubes having a uniform length. The tubes are fashioned from electrically conductive or dielectric material and are rigid or flexible, with either a smooth or structured wall surface. Spiral-type elements can furthermore be inserted into the tube inside. The tube bundle can be wetted down with the aid of a spraying device, thereby making it possible to reduce the temperature, wet and clean the tube surfaces, and increase the effectiveness of the precipitation of charged aerosols. The gas stream flows from the top toward the bottom, wherein the tube bundle end facing the gas stream is sprayed with liquid, thereby allowing the sprayed-on liquid to flow/drip in downward direction along with the gas stream.

The disadvantage of said arrangement is that the precipitation of the particles along the tube outside wall strongly decreases with a longer tube length. In addition, the wetting of the tube surface is not uniform. With larger precipitators, installation and maintenance problems occur because of the design.

SUMMARY

It is the object of the present invention to provide a tubular collector which permits a highly effective and long-term, constant precipitating along the collector tubes of electrically charged aerosols from a gas stream, as well as to remove these from the precipitator.

According to one embodiment, the tubular collector is installed in a section of the duct used for guiding the gas stream, wherein this section is positioned vertically with its duct or flow axis and the gas stream flows from the bottom toward the top.

The duct section contains at least one tube bundle group that comprises at least one tube bundle. The tube bundle group fills the clear duct cross section to the maximum possible degree, unless there are technical-physical reasons why the cross section of the tube bundle group should be smaller. For flow-technical reasons, the largest possible bundle cross section provides the lowest possible flow resistance. In any case, this allows designing differently dimensioned precipitators and, in particular, facilitates the assembly. Precipitators with a small duct cross section therefore comprise one tube bundle group or tube bundle groups with respectively one tube bundle while larger tube bundle groups comprise several tube bundles which can still be easily handled during the installation/maintenance. The tubes are all positioned parallel to the flow axis.

A spraying device is positioned centrally above each tube bundle group and is fitted onto the end of a rinsing agent supply pipe that extends outward from the exposed duct wall. With this device, rinsing liquid is sprayed uniformly onto at least the tube bundle group that faces away from the gas stream/the upper end of the tube bundle group. With a corresponding nozzle configuration, for example a dual-flow nozzle, the tube bundle group end that follows at a distance in flow direction and is exposed to the gas stream could additionally be sprayed in the same way. The rinsing liquid frequently is water, but can also be a different electrically conducting rinsing liquid.

The rinsing liquid is selected on the basis of the cleaning process to be realized. For that reason, dielectric rinsing liquids such as oils, or low alcohols, or in general electrically non-conductive solvents can also be considered, with the consequence that the tubes must be made of an electrically conductive material. Bases and acids, which are electrically conductive, can also be considered in some circumstances for the rinsing liquids. In any case, the structural components of the tubular collector which come in contact with the gas stream and the rinsing agent must be inert for this process, a fact that is taken into account for selecting the materials.

Each tube bundle group fits with at least the end facing the gas stream against a grid/perforated metal sheet, and contacts the grid electrically conductive with at least one tube. All grids/perforated metal sheets are connected to an electric reference potential, which in most cases is the ground potential. As a result, the electrical charge that is discharged during the precipitation on the tube bundle group is discharged via the respective grid, meaning the precipitated aerosols/particles are electrically neutralized and can be rinsed off along with the rinsing liquid. A tear-resistant net can furthermore be installed between the tube bundle group and the grid/perforated metal sheet, wherein the net loops must be small enough to ensure that no tube could slip through. If the net is dielectric, then an electrical connection would have to be established between the grid/perforated sheet metal and the tube bundle group.

Additional electro-technical measures are required for the insulation when reference potentials other than the ground potential are used. The tubular collector in that case is inserted completely into a dielectric duct section or, at the very least, two successive tube bundle groups are electrically insulated against each other by means of a dielectric section of the duct wall. At the same time, however, a dielectric duct wall section would have to be installed at both the inlet and the outlet side of the tubular collector to ensure the complete electrical insulation.

Immediately adjacent tubes in a tube bundle are held in place with the aid of spacers, positioned immovable and parallel to each other at a distance of $0\ \text{mm} < s \leqq D_{inside}$, while the tube bundles of a group are detachably connected to each other. $D_{inside}$ refers to the clear or inside diameter of the tube that is used.

Experiments have shown that for an optimum arrangement, a geometric triangle is formed in the tube bundle group region where all tubes appear in the cross section. The corners of this triangle rest on respectively one of the axes of three directly adjacent tubes while the resulting interstitial area between the tubes is equal to half the inside cross-sectional surface of a tube. A spacing s is thus created between the tubes, which is within the above-stated range. The flow resistance in the tube and outside of the tube appears to coincide in an optimum manner. A tube spacing that exceeds the clear tube diameter results in a considerable reduction in the degree of precipitation. If the spacing s exceeds this optimum spacing range, the charged aerosols from the central region of the flow column require more and more time for a drifting toward the tube wall and the tubes need to be longer and longer, which is technically not of interest.

To be sure, all tubes of a tube bundle group have the same length, but are positioned at different adjustment heights. The length of a tube bundle group can thus vary between the simple tube length and nearly twice the tube length when positioned on a flat grid/perforated metal sheet, wherein for reasons of dimensional stability the tube bundle group should have a center region where all tubes of a bundle are present in the cross section. In this specific bundle region, the tube bundle can additionally be bundled or tied together peripherally by means of a band or rope to increase the dimensional stability. With centrally curved or conically or pyramid-shaped grids that converge in the center, the height of the tube bundle group may even exceed twice the tube length. However, in that case the bundle height in the peripheral regions around the longitudinal axis of the tubular collector can vary only between a single tube height and less than twice the tube height, as required for the dimensional stability of the tube bundle. Successively following peripheral regions should overlap in such a way that a ring-shaped surface is created through which all tubes of the viewed peripheral regions extend. In some circumstances, a multiple, all-encompassing bundling/tying as for the flat grid case is no longer ensured in that case. With the non-flat grid forms, however, a comprehensive bundling/tying together of the tubes toward the central bundle height can still provide sufficient stability because of the approximately existing rotational symmetry. However, the structural height could then present a problem for the system installation because of space limitations.

Essential for an efficient aerosol precipitation is that the tubes are at least long enough, so that a turbulent partial gas stream entering the tube can change to a laminar stream while flowing through the tube, so that it leaves the tube in the form of a laminar partial gas stream. A constant force in radial direction acts upon the electrically charged aerosol particles in the laminar partial gas stream. In a turbulent, swirled stream, the flow-mechanical forces which constantly change direction do not allow this. In general, the force acting upon the electrically charged aerosol particles flowing through can be adjusted in radial direction within certain limits by effecting a corresponding adjustment of the reference potential. At the present time, it is technically important to adjust the reference potential in such a way that these aerosol particles drift toward the tube wall when flowing through the tube. The longer the laminar stream condition exists inside the tube, the better the precipitation. The technical effectiveness of the tube geometry, in this case the clear width and tube length, on the one hand is suggested by the stream and the therein contained aerosol type and, on the other hand, by an economic configuration of the tubular collector.

The dependent claims disclose additional features of the tubular precipitator/collector and describe a process-adapted and/or advantageous embodiment. The tubes used for a tube bundle generally are cut from piece goods, unless the processing conditions require a special kind of material. The tubes according to one embodiment, are simple, smooth-structured tubes while the tubes, according to another embodiment, are corrugated in circular peripheral or in longitudinal axial direction, wherein this also includes all helical or screw-type designs in-between. Smooth or corrugated tubes in the form of piece goods are known and are used, in particular, in the field of electrical installation technology.

Tap water is frequently used for the rinsing liquid because it has ion-conductivity. In that case, the tubes can consist of dielectric material because the tubes are connected by means of the water used as rinsing liquid to the reference potential of the supporting grid/perforated metal sheet.

The grids, which are electrically contacted by at least one tube of the associated tube bundle group, are flat in the simplest design. When using an electrically non-conductive rinsing liquid such as oil, or low alcohols, or paint solvents, care must be taken when setting up the tubular collector to ensure that the tubes attract the electrically charged particles to be precipitated. The tubes of necessity must then be electrically conductive, meaning they are at least coated with an electrically conductive coating or consist of metal or a sufficiently conductive carbon fiber composite material. The grid structure and mesh width or the perforation in the case of a perforated metal sheet is such that an individual tube bundle could not fall through.

The bundled tubes for a tube bundle group are identical. However, the tubes generally can have a multitude of different forms. According to one embodiment, the tubes may have a round cross section and, according to another embodiment, they are polygonal. This aspect may have to be taken into consideration for smaller duct cross sections because of the flow resistance, but becomes less important with larger duct cross sections if the cross section of the tube bundle group extends over most of the clear duct width.

A narrow embodiment of a tube bundle is described in one embodiment, where the tube cross section is polygonal, meaning rectangular (hexagonal and/or honeycomb-type structure), or takes the form of a parallelogram with four corners, or is a regular hexagon or triangle, such that a rectangle or parallelogram with four corners is formed when two triangles are fitted against each other. The tubes of a bundle are furthermore packed densely, meaning the spacing s between the tubes is zero or nearly zero. A tube bundle of this type has a honeycomb-type structure and can be bundled/tied together using tubes with different height adjustments, or the tubes of a bundle all have the same height adjustment. A tube bundle of this type, however, can also be cut directly from a cohesive honeycomb structure with the respective honeycomb cross section, that is to say with ends that are parallel to each other and perpendicular to the longitudinal tube axis, or at an angle thereto. Both types of tube bundles are suitable for combining into a tube bundle group, in particular if the ends of the tube bundle group are not flat and a segmented structure is therefore required. The mounting and anchoring of such structures is technically simple because honeycomb structures of this type are known from lightweight construction technology.

The tubes can be secured by means of two easy methods, either with w-shaped clamps as described in one embodiment, or with the aid of at least two grids through which all tubes of the at least one tube bundle extend, as described in another embodiment. The two grids have a grid structure through which the tubes can be fitted and clamped in, such that they retain their shape. The grid openings have a polygonal or at the very least a triangular structure. With the w-shaped clamp, which can be obtained through stamping it out of a ribbon of suitable material, the tube spacing s is achieved by making use of the center web of the W. Two tubes are simultaneously held in the clamped position by means of the outside and the center web. Respectively two W-clamps hold two tubes in a position where they are parallel to each other. Different cross-sectional forms can thus be created for a tube bundle group, ranging from round such as circular or oval to polygonal with straight edges, starting with triangular, or polygonal with two corners and curved edges, wherein the circular, or rectangular, or hexagonal cross sections are realized most often. For all simple cross sectional shapes that are curved toward the outside, a peripheral bundling/tying together of the tube bundle group in the region where all tubes appear in the cross section offers additional dimensional stability and permits a simple anchoring to the duct wall.

As described in one embodiment, the degree of precipitation can be further optimized if the tubes from one tube bundle group, or at least most of them, are not aligned with the tubes of the adjacent tube bundle group. The effect achieved therewith is that the laminar flow columns leaving one tube bundle group are cut in axial-flow direction when entering the following tube bundle group, provided the laminar flow condition can be maintained in the space between two tube bundle groups. As a result, the formerly central region of a flow column in all probability will be decentralized when entering the following tube bundle group and will continue to flow near a tube inside wall or outside wall. Aerosol particles which may still be present in the formerly central flow column region then have a shorter radial path to the present tube wall.

The tubular precipitator/collector has a simple design and is lightweight, either in the form of a small device with only one tube bundle in each tube bundle group, or as a larger to large unit with modular configuration and several tube bundles in each tube bundle group.

The tubular precipitator/collector can be used to effectively clean a gas loaded with electrically charged aerosols while it flows through the system. The pressure drop between inlet and outlet of the tubular precipitator/collector is small if the tube spacing remains within the limits of $0\ mm<s<D_{inside}$, in particular if the tube spacing is adapted to the flow resistance on the inside of the individual tubes—all tubes have the same flow resistance since they are geometrically identical in each group—and on the outside between a triplet of immediately adjacent tubes. The goal therefore is to achieve the highest possible utilization of the inside and outside tube surfaces since the gas to be cleaned flows on the inside of the tubes as well as through the interstitial areas outside of the tubes, which delimit the tube outside wall. As a result, the flow along the tube outside surface is as strong as it is along the tube inside surface. The tube outside surface therefore becomes an effective surface owing to the spacers, which increases the precipitation surface by a maximum of up to 65%/35%=1,86 times.

BRIEF DESCRIPTION OF THE DRAWINGS

The design and operation of a tubular collector of this type, constructed and subjected to a testing phase, is described in further detail with the aid of the exemplary embodiment. The drawing contains sketched views of the tubular collector as well as a diagram of its capacity.

Shown are in.

DETAILED DESCRIPTION

Figure 1:
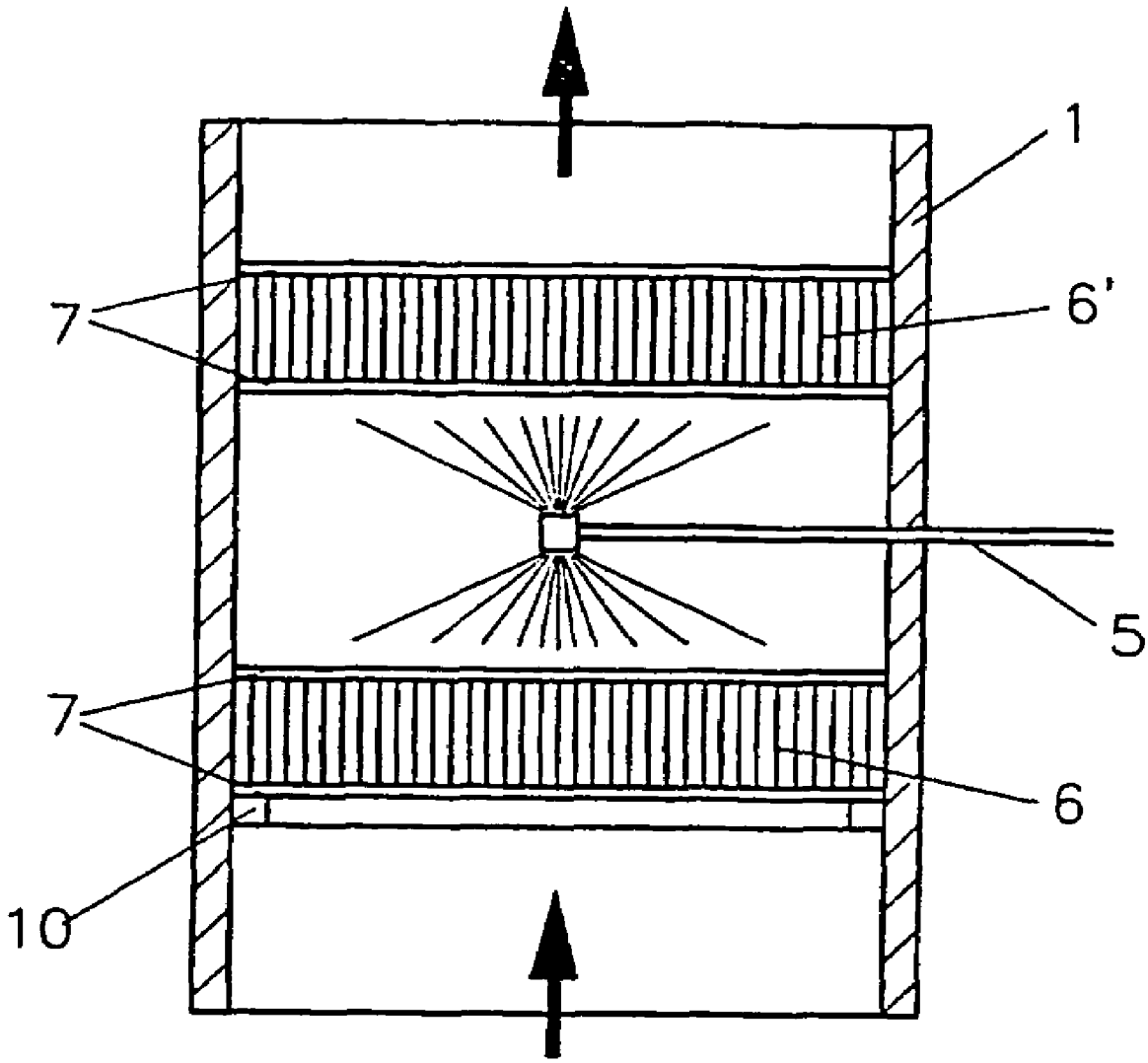
FIG. 1 the tubular collector.

FIG. 1 shows the tubular collector in the position where it is installed in the duct system for guiding a gas stream to be cleaned of electrically charged aerosol particles. The flue gas or crude gas herein flows from the bottom into the tubular collector and normally flows in a turbulent stream against the first, lower tube bundle group which extends across to the total internal cross section of the duct. There, the crude gas initially reaches the flat grid that also extends across the clear duct width and is connected to ground potential. Laminar flow columns are formed inside the tubes and between the tubes, in downstream direction along the flow path. These laminar flows are loaded with aerosol particles, which generally have a negative electric charge and are attracted in radial direction toward the closest tube wall because of the electric ground potential that is effective. While the gas stream flows through, at least the aerosol particles near a tube wall have a good chance of hitting the tube wall and releasing their electric charge. The force acting upon the aerosol particles is a combination electrical and flow-mechanical force.

The spraying device is positioned midway and centrally between the two tube bundle groups. The rinsing agent is supplied by means of a pipe that projects inward from the exposed duct wall. The rinsing agent in this case is water, which is well suited for rinsing off the deposited flue gas particles. The spraying device sprays onto the lower as well as the upper tube bundle group.

The pre-cleaned gas, flowing in laminar columns out of the first tube bundle group, continues to flow through the intermediate spraying zone until it reaches the second tube bundle group that is also positioned on a grid connected to an electric reference potential. The still laminar flow columns arriving from the first tube bundle group will most likely be cut in longitudinal direction upon entering, thus again forming laminar flow columns in downstream direction which results in the additional precipitation. The gas is mostly cleaned when it exits the second tube bundle group and continues to flow through the connected guiding duct. The rinsing effect can be further improved by installing a different spraying device above the last tube bundle group for spraying the side facing away from the gas stream/the top side. However, this measure is not absolutely required.

The grid connected to ground on the tube bundle side facing the gas stream is necessary for discharging the electrical charge. The rinsing of the tube bundle with the spraying device, positioned between two successive tube bundles in the direction counter to the flow direction of the gas, effectively acts only upon precipitated and electrically neutral particles. An additional grid for connecting to ground on the tube bundle side facing away from the gas stream does not substantially increase the degree of precipitation, but can contribute to the mechanical stability of the tube bundle if the connection is good.

With this type of installation, the two flat grids make it possible for rinsing liquid containing aerosols to simply drip in counter-flow direction into the space below. This is not generally a problem with this type of design and configuration of the tubular collector because an aerosol-polluted rinsing liquid of this type can be collected easily in a trough below the tubular collector and can be discharged from there.

Figure 2:
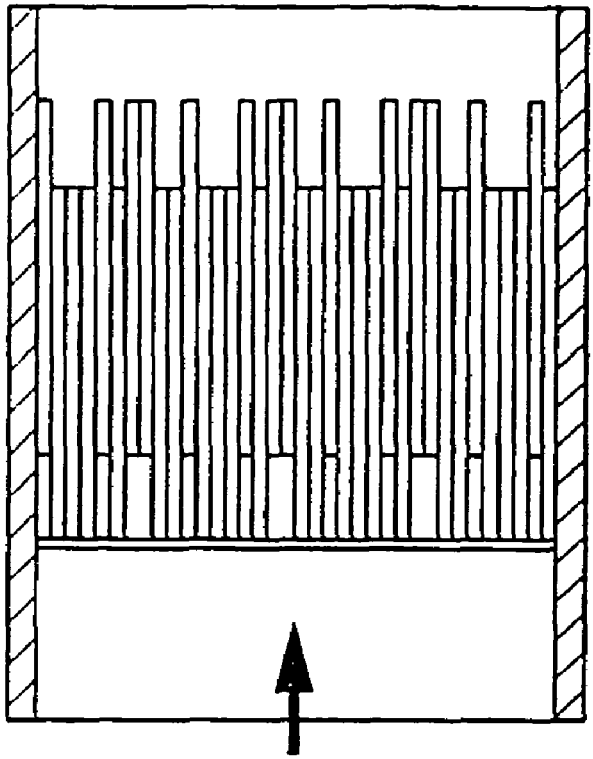
FIG. 2 an axial section through the installed tube bundle group.
Figure 3:
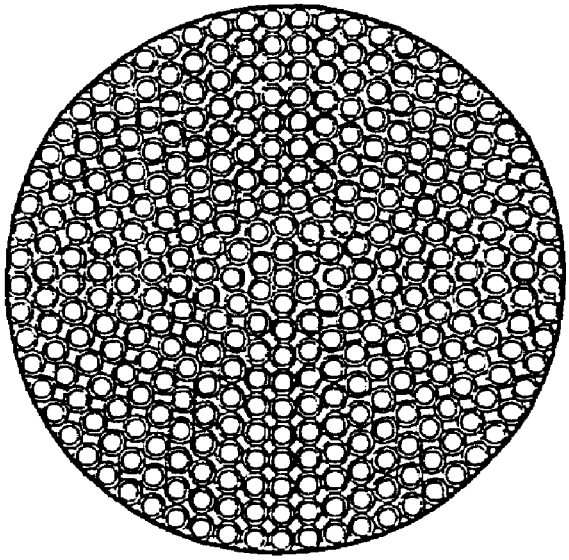
FIG. 3 a radial section through the installed tube bundle group.

The particles to be precipitated out are for the most part in the range of <1 μm. Since the tube length is not optionally long, not all particles in the gas stream will precipitate out along the tube wall; some will continue to move along with the gas stream. During an experiment it was discovered that if the tubes in a tube bundle are packed with different height adjustments, considerable sedimentation traces appear on the outside wall of a tube which extends past a lower-positioned tube. Measurements have confirmed this observation. The precipitation in a tube bundle where the packed tubes are positioned with different height adjustments is significantly higher than for bundles packed only at the height adjustment of one tube length. FIG. 2 schematically shows that the tubes of the tube bundle group, installed in the tubular collector and extending across the inside duct cross section, are positioned at different heights. For reasons of simplicity, only two heights are used in this case. The cross-sectional view in FIG. 3 shows a dense packing of the tubes, meaning the tubes are arranged extremely close to each other.

Figure 4:
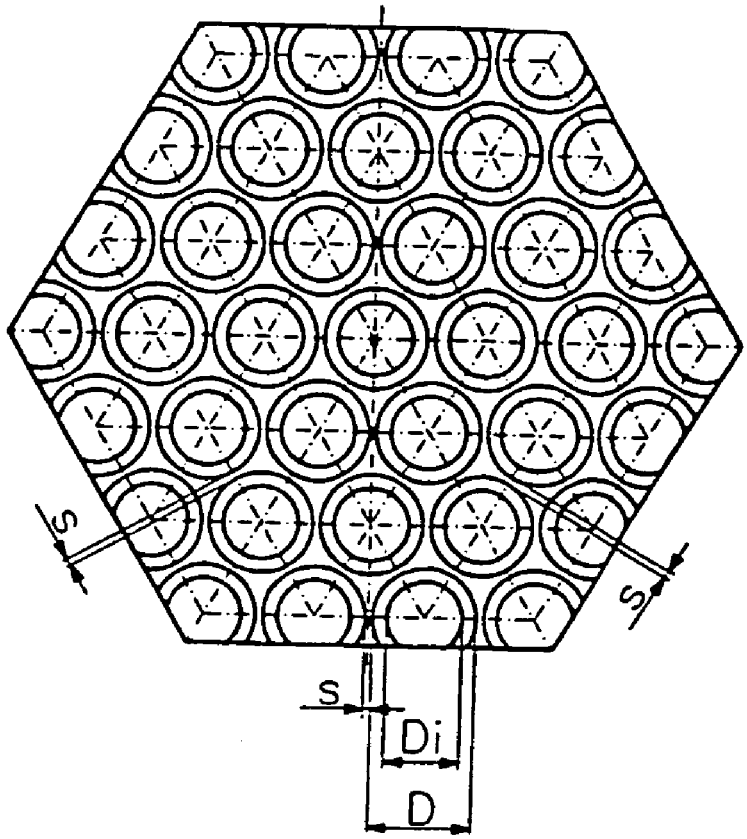
FIG. 4 the tubes positioned at a distance s to each other.
Figure 5:
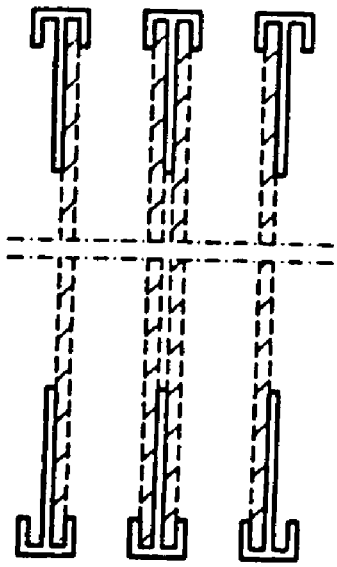
FIG. 5 an axial section through tubes positioned relative to each other.
Figure 6:
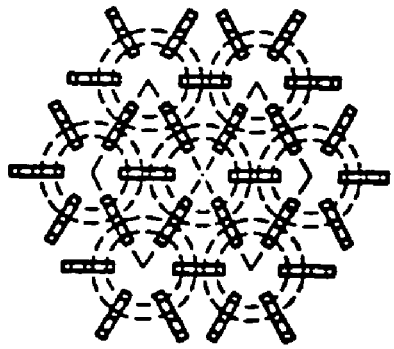
FIG. 6 a radial section through tubes positioned relative to each other.

FIG. 4 shows an example of a cross section through a tube arrangement for which the tubes are arranged in an orderly manner, meaning with their longitudinal axes positioned in the corners of an equilateral triangle. The identical tubes have an inside diameter $D_{inside}$ and an outside diameter D. They are positioned parallel to each other and spaced apart at the distance s by means of fitted-on clamps in the shape of a w (see also FIG. 5, longitudinal section, and FIG. 6, cross-section). The clamps shown herein are designed for a bundle for which the tube height equals the tube length. If the tubes are packed to be positioned at different heights, the two outside legs of the clamps must be correspondingly longer.

The w-shaped spacers/clamps are inserted from the bottom and the top of each tube end. Respectively 6 spacers are inserted from the top and bottom of each tube, wherein respectively 1 spacer always keeps 2 tubes positioned at the distance s. For a better tube guidance and to provide an extended feed-in section for the gas, the central spacing bars having the width s can be longer, for example having a length of 5×D or 10×D. They can also be designed long enough, so that the lower and upper central bars touch precisely in the tube center and form a closed interstitial channel. The spacers are easy to produce, for example by punching them out of sheet metal or thin plastic sheets. Depending on the required resistance to the media and temperature, the materials can consist either of plastics such as PE, PP, PVDF, PTFE, PVC, or metals such as aluminum, stainless steel, titanium.

A technically usable spacing range is $$0<s<D_{inside}$$

For a finite distance adjustment, the optimum adjustment range for s is $$0.15\ D_{inside} \leqq S \leqq 0.25\ D_{inside}$$

The design of a tube bundle can be supported by an application-specific computation of the spacing with the aid of known flow-mechanical pressure-loss calculations.

An examination of a simple, orderly packed bundle of circular tubes naturally results in a hexagonal bundle cross section as shown in FIG. 4, wherein all tubes are identical and have the inside diameter $D_{inside}$ and the same outside diameter D. The following optimal tube spacing is obtained for an estimated tube length of 1 m and a laminar flow, assuming a flow speed through the tube of 2 m/s and a pressure drop dp=5.12 Pa over the tube length and taking into account the cross-sectional geometry:

$$s=0.254\ D_{inside}$$

In that case, approximately the same amount of gas to be cleaned flows through the tube as flows through the interstitial areas. Since approximately 65% of the tube surface is available to the gas streaming through these interstitial areas, about 65% of the total gas can also flow through these areas, meaning 65/50=1.3 times the amount of gas streaming through the tubes.

The tube outside surface becomes an effective area by inserting the spacers, which increases the effective precipitation surface by a maximum of 65%/35%=1.86 times. Owing to the spacers, fewer tubes can be installed inside the predetermined housing volume which, for the present example, means that approximately 27% fewer tubes can fit into the housing than for a tighter packing with s=0 mm. That is to say, the total tube surface is reduced by 27%. However, since approximately 1.8 times the surface area thereof is usable because of the spacers, it means that approximately 1.8×0.73=1.31 times the precipitation surface is obtained with a 27% lower tube use.

Figure 7:
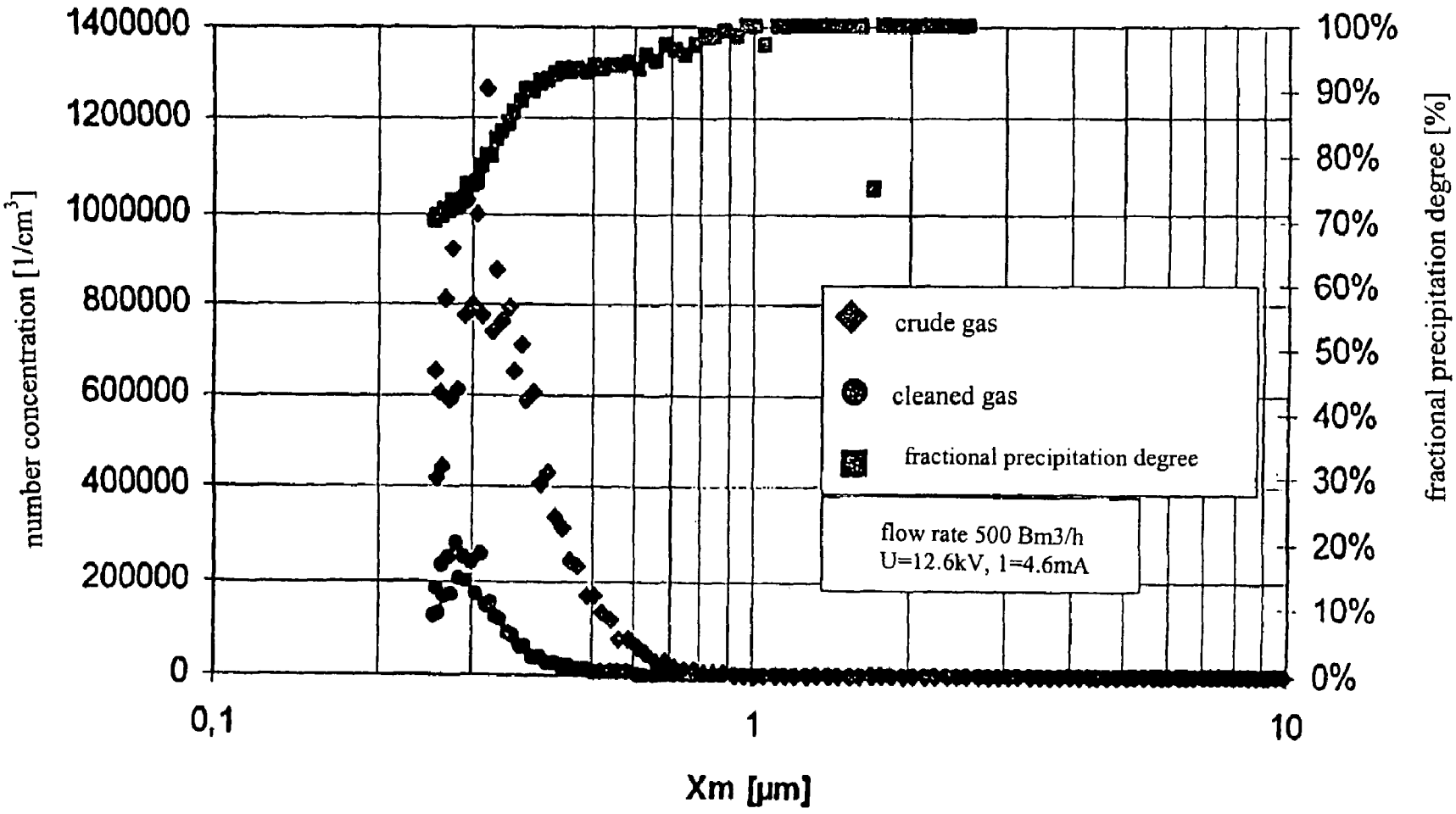
FIG. 7 the number concentration and the fractional precipitation degree.

The capacity of the tubular precipitator/collector is documented with an example in FIG. 7. The example shows the experimentally determined curves for the number concentration in $cm^{-3}$ and the fractional precipitation degree in %, both above the particle size Xm in μm. The flow rate for this example was 500 Bm3/h. The crude gas was loaded with electrically charged particles before entering the tube precipitator, while passing through an electrostatic charging unit with U=12.6 kV, wherein the charging unit drew a current of I=4.6 mA. Starting with a particle size of approximately 0.4 μm, the fractional precipitation degree already exceeds 90% and the quality of the cleaned gas is excellent. Starting with a particle size of 1 μm, the conditions are nearly ideal.

It will be understood that the above description of the present invention is susceptible to various modifications, changes and adaptations, and that the same are intended to be comprehended within the meaning and range of equivalents of the appended claims.

The invention claimed is:

1. A tubular collector for precipitating out electrically charged aerosols from a gas stream, comprising:

a vertical section of a duct used for guiding the gas stream from a bottom of the duct to a top of the duct;

at least one tube bundle group anchored in the section of the duct, the tube bundle group comprising at least one tube bundle that extends across a cross section of the duct and includes an upper end and lower end, wherein at least the lower end is positioned to face the gas stream;

a grid, coupled to the at least one tube bundle group, that extends across the cross section of the duct and is further connected to an electric reference potential, wherein at least one tube of the at least one tube bundle conductively contacts the grid to discharge an absorbed electrical charge; and a spraying device mounted centrally above the tube bundle that uniformly sprays a rinsing liquid on at least the upper end of the tube bundle, wherein immediately adjacent tubes in the tube bundle are positioned parallel to one another and at a distances of 0 mm$\leqq s \leqq D_{inside}$ relative to each other, with $D_{inside}$ representing the inside diameter of the tubes, and wherein the tubes in the at least one tube bundle group have different adjustment heights.

2. The tubular collector according to claim 1, wherein the grid is flat, concave, convex, pyramid-shaped, or conical, facing the gas stream.

3. The tubular collector according to claim 2, wherein the tubes have a smooth texture.

4. The tubular collector according to claim 1, characterized in that wherein the tubes have a corrugated structure including corrugations that range from longitudinal axial to circular.

5. The tubular collector according to claim 3, wherein the tubes comprise dielectric material and the rinsing liquid comprises an electrically conducive liquid.

6. The tubular collector according to claim 3, wherein the tubes comprise electrically conductive material in electrical connection with one another, and the rinsing liquid comprises an electrically non-conducive liquid.

7. The tubular collector according to claim 5, wherein the tubes have a round cross section.

8. The tubular collector according to claim 5, wherein the tubes have a polygonal cross section.

9. The tubular collector according to claim 5, wherein the tubes in each tube bundle have a polygonal cross section and are densely packed in a honeycomb configuration.

10. The tubular collector according to claim 7, wherein spacers of the immediately adjacent tubes are w-shaped and are respectively fitted onto two tubes to clamp the two tubes spaced apart from one another.

11. The tubular collector according to claim 7, wherein the tubes of a tube bundle are clamped in and extend through at least two grids to secure spacing.

12. The tubular collector according to claim 9, wherein the longitudinal axes of two successively following tube bundle groups coincide with the flow axis of the gas stream, and wherein a plurality of the tubes in one tube bundle group are not aligned with those of the adjacent tube bundle group.

13. The tubular collector according to claim 1, wherein the electrical reference potential differs from a ground potential, and the duct has a wall that is dielectric at least on an inlet side and an outlet side of the tubular collector.

14. The tubular collector according to claim 1, wherein the tube bundle groups follow each other at a distance in flow direction, and the duct has a wall with an intermediate section that is dielectric to operate as electric insulation.

15. The tubular collector according to claim 1, wherein the duct section has an electrical conductivity that is adaptable based on the difference between the reference potential and a ground potential.

16. The tubular collector according to claim 1, wherein the spraying device is supplied with the rinsing liquid by a feed line projecting from an exposed wall of the duct.

17. The tubular collector according to claim 1, wherein the gas stream entering the tube is turbulent, and the length of each tube is adaptable to create a laminar gas stream downstream of the tubular collector.

18. The tubular collector according to claim 9, wherein the polygonal cross section comprises at least one of a rectangle or parallelogram with four corners, and a regular hexagon or triangle, wherein a diagonal line bisecting the polygonal cross section defines two triangles.

* * * * *